US006750406B2

(12) United States Patent
Komatsu et al.

(10) Patent No.: US 6,750,406 B2
(45) Date of Patent: Jun. 15, 2004

(54) TWO-STAGE MOVEMENT SEESAW SWITCH APPARATUS

(75) Inventors: Shinji Komatsu, Miyagi-ken (JP); Ruriko Yusa, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/680,517

(22) Filed: Oct. 7, 2003

(65) Prior Publication Data

US 2004/0074747 A1 Apr. 22, 2004

(30) Foreign Application Priority Data

Oct. 21, 2002 (JP) ..... 2002-306027

(51) Int. Cl.[7] ..... H01H 9/26
(52) U.S. Cl. ..... 200/1 B
(58) Field of Search ..... 200/1 B, 5 R, 200/4, 17 R, 18, 339, 517, 553

(56) References Cited

U.S. PATENT DOCUMENTS 5,426,275 A 6/1995 Maeda et al. ..... 200/553
5,430,261 A 7/1995 Malone ..... 200/1 B
5,623,134 A 4/1997 Hayakawa ..... 200/5 R
5,693,920 A 12/1997 Maeda ..... 200/1 B
5,719,361 A 2/1998 Lee ..... 200/1 B
5,736,703 A * 4/1998 Kim ..... 200/1 B
5,753,874 A 5/1998 Kossakowski ..... 200/1 B
5,834,716 A * 11/1998 Lee ..... 200/5 R
6,437,259 B1 * 8/2002 Geppert et al. ..... 200/5 R

* cited by examiner

*Primary Examiner*—Michael A. Friedhofer
(74) *Attorney, Agent, or Firm*—Brinks Hofer Gilson & Lione

(57) ABSTRACT

A seesaw switch apparatus includes a manipulation knob which is tiltably supported, an operation plate which has an approximately L-shape in a plan view and is pushed and driven by the manipulation knob by way of a driver, first and second push switches which support both ends of the operation plate, and a third push switch which supports a bend of the operation plate. The driver is brought into contact with a portion of the operation plate closer to the first push switch than the third push switch, and the driver is brought into contact with a portion of the operation plate closer to the second push switch than the third push switch. The operation plate sequentially operates the first and third push switches in response to a descending amount of the driver and also sequentially operates the second and third push switches in response to a descending amount of the driver.

5 Claims, 7 Drawing Sheets

TWO-STAGE MOVEMENT SEESAW SWITCH APPARATUS

BACKGROUND OF THE INVENTION

1. Field of the Invention

The present invention relates to a two-stage movement seesaw switch apparatus which is preferably used as a switch for a power window of an automobile, for example, and outputs a first-stage electric signal and a second-stage electric signal in response to a tilting angle of a tiltably supported manipulation knob.

2. Description of the Related Art

As this type of two-stage movement seesaw switch apparatus, conventionally, there has been proposed a switch apparatus which includes a manipulation knob which is tiltably supported, a pair of operation plates to which a pushing force is applied from the manipulation knob by way of drivers, and two sets of push switches each made up of two push switches (that is, four push switches) which support the respective operation plates, wherein one operation plate is driven by pushing and is tilted in response to the tilting direction of the manipulation knob and the push switch is operated by the tilted operation plate (see Patent Reference 1, for example). In such a conventional seesaw switch apparatus, each set of pushing switches made up of two push switches are arranged at positions whose distances to the tilting center line of the manipulation knob differ, and a straight line which connects both push switches obliquely intersects the tilting center line and, at the same time, two opposing corners of the operation plate having an approximately parallelogram in a plan view are supported on both push switches, whereby these two push switches are sequentially operated in response to the tilting angle of the manipulation knob.

That is, when a manipulator performs tilting manipulation of the manipulation knob so as to lower one side of the manipulation knob, a driver which is positioned below one side is pushed and descends, and the corresponding operation plate is tilted using the push switch close to the tilting center line of the manipulation knob as a fulcrum and hence, the push switch which is away from the tilting center line is pushed by the operation plate and performs an ON operation. In this state, when the manipulation knob is further tilted and the driver further descends, the operation plate is tilted using the push switch in the ON state which is away from the tilting center line as a fulcrum this time and hence, the push switch which is close to the tilting center line is pushed by the operation plate and performs the ON operation. Further, when the arbitrary push switch is made to perform the ON operation and, thereafter, the manipulation force applied to the manipulation knob is released, the operation plate is pushed upwardly due to a restoring force of the push switch which is pushed by the operation plate and hence, the manipulation knob is pushed back to a neutral position and the push switch restores the OFF state. Here, in this conventional proposal, each of the push switches is constituted of a fixed contact arranged on a board and a click rubber having a movable contact which is brought into contact with and is separated from the fixed contact and is capable of performing buckling deformation. The push switch is configured such that the operation plate is supported on a top of the click rubber and when the click rubber is pushed by the operation plate and performs the buckling deformation at the time of manipulation, the movable contact and the fixed contact are brought into contact with each other while generating a click feeling.

In such a conventional two-stage movement seesaw switch apparatus, it is possible to arrange four push switches in a relatively compact manner and the push switches exhibit a favorable manipulation feeling and hence, the switches are suitable as power window switches of an automobile or the like. In this case, two push switches which are operated by one operating plate output electric signals to open windows and remaining two push switches which are operated by another operating plate output electric signals to close the windows. Further, the two-stage movement seesaw switch apparatus may be configured such that the opening signals and the closing signals of the push switches which are away from the tilting center line of the manipulation knob are outputted only during the ON operation, while the push switches which are close to the tilting center line of the manipulation knob output the signals which make the windows completely open or completely close during the ON operation. Due to such a constitution, the manipulator can perform the manual operation to open or close the windows by an arbitrary amount by tilting the manipulation knob with a shallow angle and can perform an automatic operation to make the window fully open or fully close by tilting the manipulation knob with a deep angle.

[Patent Reference 1]

U.S. Pat. No. 5,693,920

The above-mentioned two-stage movement seesaw switch apparatus has succeeded in making the switch apparatus compact to some extent by providing the idea that the straight line which connects one set of push switches made up of two push switches is made to obliquely intersect the tilting center line of the manipulation knob. However, it is difficult for the switching apparatus to satisfy further miniaturization of the device and further reduction of cost derived from reduction of the number of parts.

SUMMARY OF THE INVENTION

The present invention has been made in view of the above-mentioned circumstances and it is an object of the present invention to provide a two-stage movement seesaw switch apparatus which can facilitate the miniaturization of the device and the lowering of cost.

To achieve the above-mentioned object, a two-stage movement seesaw switch apparatus of the present invention is constituted such that the switch apparatus includes a manipulation knob which is tiltably supported, a pair of drivers corresponding to a tilting direction of the manipulation knob, an operation plate which is pushed and driven by the manipulation knob by way of the drivers, a first push switch and a second push switch which support both ends of the operation plate, and a third push switch which is arranged at a position displaced from a straight line which connects both push switches and supports an intermediate portion of the operation plate, wherein one of the drivers imparts a pushing force from the manipulation knob to a portion of the operation plate closer to the first push switch than the third push switch so as to make the operation plate sequentially operate the first push switch and the third push switch in response to a descending amount of the driver, and another of the drivers imparts a pushing force from the manipulation knob to a portion of the operation plate closer to the second push switch than the third push switch so as to make the operation plate sequentially operate the second push switch and the third push switch in response to the descending amount of the driver.

In the seesaw switch apparatus having such a constitution, when the manipulation knob is tiltably manipulated, one of the drivers descends and imparts the pushing force from the manipulation knob to the portion close to one end or another end of the operation plate. For example, when the pushing force from the manipulation knob is imparted to the portion of the operation plate closer to the first push switch than the third push switch due to the tilting manipulation of the manipulation knob, the operation plate is, first of all, tilted using the third push switch as a fulcrum and hence, the first push switch performs the ON operation. When the manipulation knob is further tilted in this state, this time, the operation plate is tilted using the first push switch held in the ON state as a fulcrum so that the third push switch performs the ON operation. Here, since the third push switch is arranged at the position displaced from the straight line which connects the first push switch and the second push switch, the pushing force from the manipulation knob is hardly applied to the second push switch and there is no possibility that the second push switch performs the ON operation. Further, when the manipulation knob is tiltably manipulated in the reverse direction so as to make the driver impart the pushing force from the manipulating knob to the portion of the operation plate closer to the second push switch than the third push switch, in the same manner as the above-mentioned operation, first of all, the operation plate is tilted using the third push switch as a fulcrum so that the second push switch performs the ON operation. When the manipulation knob is further tilted in this state, the operation plate is tilted using the second push switch as a fulcrum so that the third push switch performs the ON operation. Here, due to the same reason as the above-mentioned operation, the pushing force from the manipulation knob is hardly applied to the first push switch and hence, there is no possibility that the first push switch performs the ON operation. Accordingly, using three push switches which are driven by pushing the common operation plate, it is possible to take out four types of electric signals, namely the signal which is outputted when only the first push switch assumes the ON state, the signal which is outputted when both of the first and the third push switches assume the ON state, the signal which is outputted only when the second push switch assumes the ON state, and the signal which is outputted when both of the second and the third push switches assume the ON state. That is, the seesaw switch apparatus which is capable of outputting four types of electric signals in response to the tilting direction and the tilting angle of the manipulation knob can be realized using a small number of parts and hence, the number of the push switches and the operation plate can be reduced whereby the miniaturization can be facilitated.

According to the two-stage movement seesaw switch apparatus of the present invention, in addition to the above-mentioned constitution, the operation plate is formed in an approximately L-shape in a plan view and includes a bend which is supported by the third push switch as well as a first extension and a second extension which extend from the bend in a truncated chevron shape, wherein a distal end of the first extension is supported by the first push switch and a distal end of the second extension is supported by the second push switch. In this case, it is possible to easily ensure a space which faces a bottom face of the manipulation knob in an opposed manner between the first extension and the second extension of the operation plate and hence, by providing an illuminator which is exposed to the space in a projecting manner at a side of the third push switch, it is possible to realize without difficulty the two-stage seesaw switch apparatus of an illumination type.

Further, the operation plate having an approximately L-shape in a plan view may include a first resilient portion which connects the bend with the first extension, a first pushing force transmission portion which is projected from the first extension to the bend side and pushes the bend when the first extension is tilted using the first push switch as a fulcrum due to the pushing force of the manipulation knob, a second resilient portion which connects the bend with the second extension, and a second pushing force transmission portion which is projected from the second extension to the bend side and pushes the bend when the second extension is tilted using the second push switch as a fulcrum due to the pushing force of the manipulation knob. In this case, compared to a case where the operation plate formed of a single sheet of plate is used, a risk that respective push switches are erroneously operated is significantly decreased. That is, when the first extension is tilted using the third push switch as a fulcrum due to the pushing force from the manipulation knob, the first resilient portion is resiliently deformed and hence, the pushing force from the manipulation knob is hardly transmitted to the bend whereby there is no possibility that the third push switch is erroneously operated when the first push switch is operated. Further, when the first extension is tilted using the first push switch held in the ON operation as a fulcrum, the bend is surely pushed by the first pushing force transmission portion so that the third push switch can be operated and, at the same time, since the second resilient portion receives the resilient deformation, the pushing force from the manipulating knob is hardly transmitted to the distal end of the second extension. Accordingly, there is no possibility that the second push switch is erroneously operated. Here, these operations in series are basically performed in the same manner in tilting the second extension.

Further, each of the push switches may include a fixed contact and a click rubber which is provided with a movable contact which is brought into contact with or is separated from the fixed contact and is capable of performing the buckling deformation, and a top of the click rubber engages with the operation plate. Due to such a constitution, it is possible to provide an inexpensive push switch which can obtain a clear click feeling and a sufficient restoring force. Further, these push switches exhibit the favorable assembling property. Accordingly, it is preferable to adopt the push switch having such a constitution.

DESCRIPTION OF THE PREFERRED EMBODIMENTS

Figure 1:
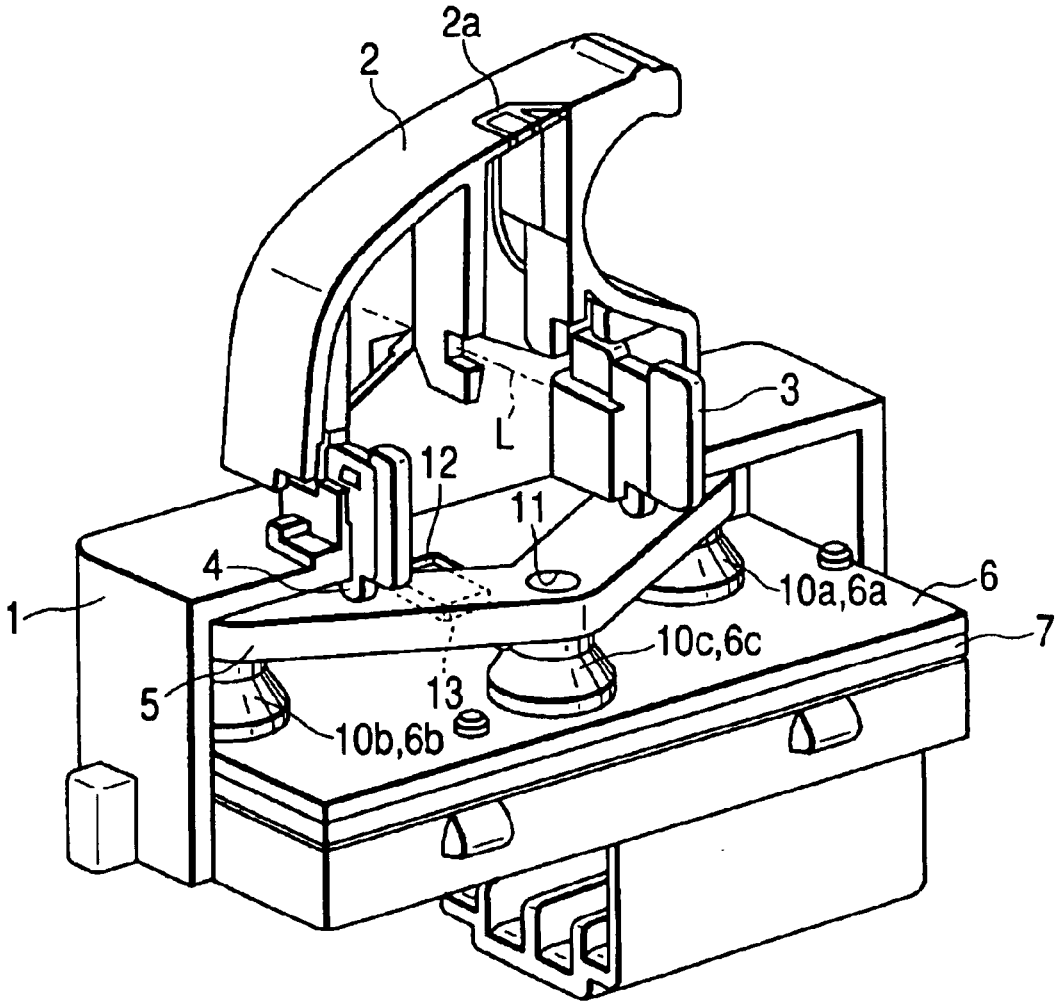
FIG. 1 is a perspective view showing a two-stage movement seesaw switch apparatus according to one embodiment of the present invention.

The present invention is explained hereinafter in conjunction with drawings from FIG. 1 to FIG. 6.

A two-stage movement seesaw switch apparatus shown in these drawings is used as a power window switch of an automobile. The seesaw switch apparatus is mainly constituted of a casing 1 which forms an outer shell, a manipulation knob 2 which is tiltably supported on a support shaft not shown in the drawing on the casing 1 and is provided with a display portion 2*a* on an upper surface thereof, a pair of elevatable drivers 3, 4 which are provided corresponding to the tilting direction of the manipulation knob 2, an operation plate having an approximately L-shape in a plan view which is driven by pushing of the manipulation knob 2 by way of the driver 3 or 4, a rubber sheet 6 on which click rubbers 6*a* to 6*c* are formed in a projected manner, and a board 7 on which the rubber sheet 6 is mounted.

Figure 2:
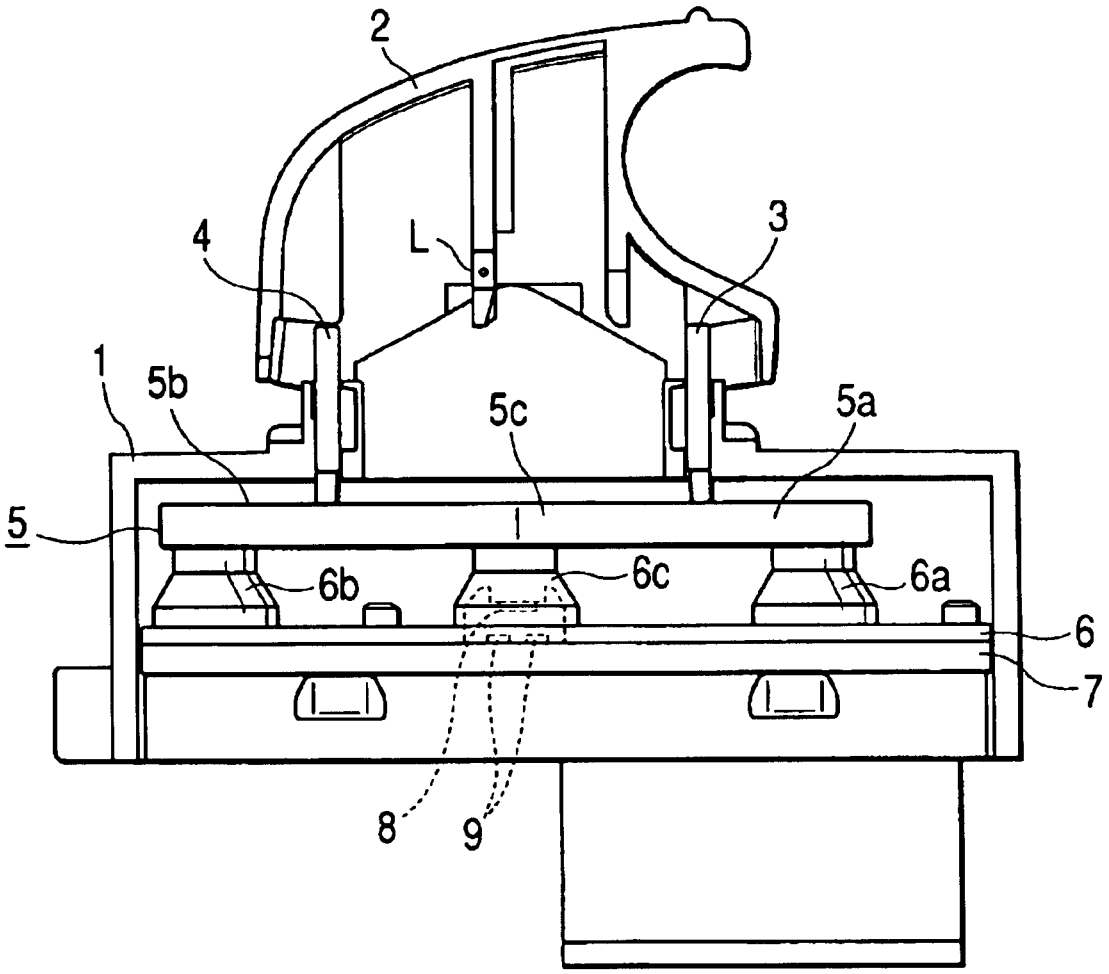
FIG. 2 is a side view of the seesaw switch apparatus shown in FIG. 1.
Figure 3:
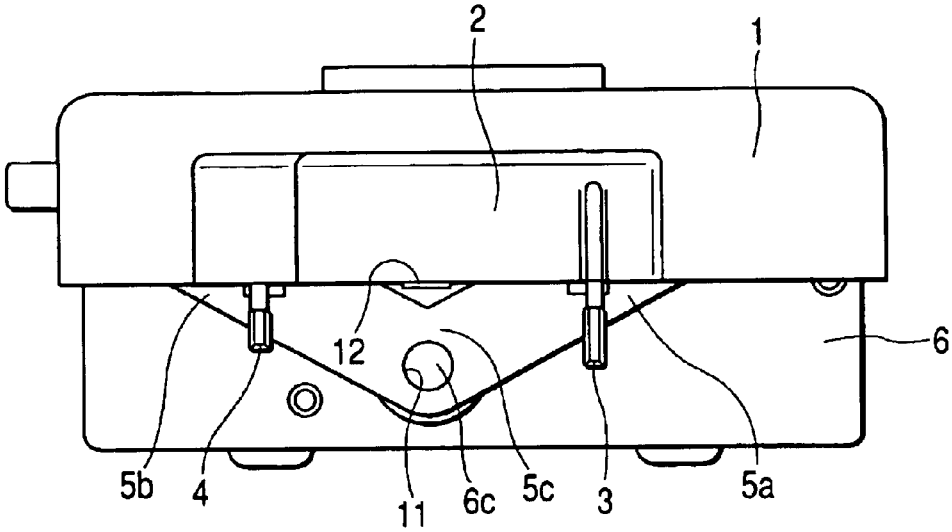
FIG. 3 is a plan view of the seesaw switch apparatus shown in FIG. 1.
Figure 4A:
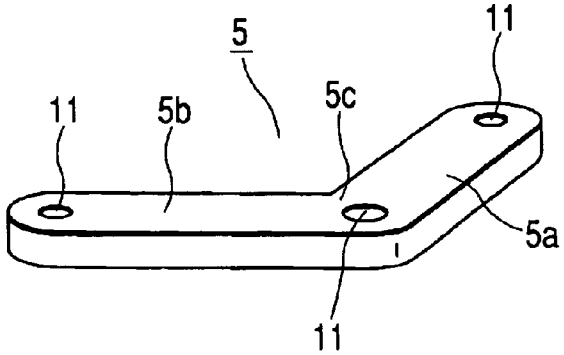
FIG. 4*a* is a perspective view of an operation plate used in the seesaw switch apparatus shown in FIG. 1.
Figure 4B:
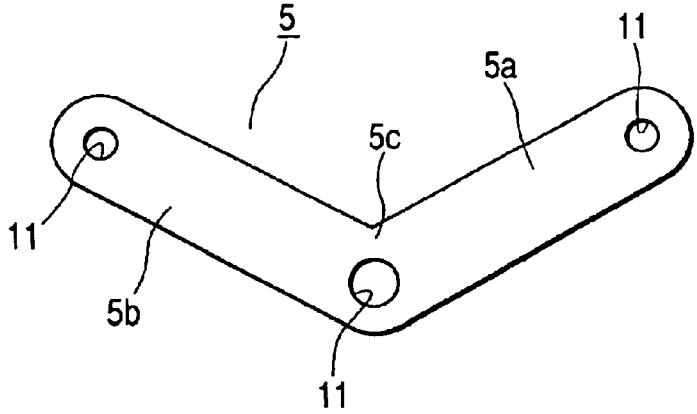
FIG. 4*b* is a plan view of the operation plate shown in FIG. 4*a;*

As shown in FIG. 2, on ceiling faces of the respective click rubbers 6*a* to 6*c*, movable contacts 8 are formed, while fixed contacts 9 are formed on the board 7 at positions which face the respective movable contacts 8. Each of the movable contacts 8 is brought into contact with the fixed contact 9 disposed below the movable contact 8 when the click rubber which constitutes a holding body is subjected to buckling deformation and hence, a contact portion of a push switch is constituted of the corresponding movable contact 8 and fixed contact 9. That is, the first push switch 10*a* which uses the click rubber 6*a* as the holding body, the second push switch 10*b* which uses the click rubber 6*b* as the holding body, and the third push switch 10*c* which uses the click rubber 6*c* as the holding body are arranged on the board 7 and tops of the respective click rubbers 6*a* to 6*c* are inserted into and engage with the inside of engaging holes 11 formed in the operation plate at three positions.

The operation plate includes a bend 5*c* which constitutes an intermediate portion and a first extension 5*a* and a second extension 5*b* which extend from the bend 5*c* in a truncated chevron shape. A distal end of the first extension 5*a* engages with and is supported by the top of the first push switch 10*a*, a distal end of the second extension 5*a* engages with and is supported by the top of the second push switch 10*b*, and the bend 5*c* engages with and is supported by the top of the third push switch 10*c*. Here, since the operation plate has an approximately L-shape in a plan view, the third push switch 10*c* is arranged at a position displaced from a straight line which connects the first and second push switches 10*a*, 10*b*. Further, on the board 7, at a side of the third push switch 10*c*, an illuminator (LED) 13 which is exposed in an opening 12 formed in the rubber sheet 6 is mounted, wherein the illuminator 13 is exposed in a projected manner between the first extension 5*a* and the second extension 5*b* of the operation plate 5.

The manipulation knob 2 is tiltable about a tilting center line L which is an axis of the support shaft and is tilted in the clockwise direction and in the counterclockwise direction in FIG. 2 along with the rotational manipulation thereof. When the manipulation knob 2 is rotatably manipulated in the clockwise direction and is tilted, one driver 3 is pushed so that the driver 3 descends, while when the manipulation knob 2 is rotatably manipulated in the counterclockwise direction and is tilted, another driver 4 is pushed so that the driver 4 descends. Here, a lower end of one driver 3 is brought into contact with a portion of the operation plate 5 which is on a straight line which connects the first push switch 10*a* with the third push switch 10*c* and closer to the first push switch 10*a* than the third push switch 10*c*, while a lower end of another driver 4 is brought into contact with a portion of the operation plate 5 which is on a straight line which connects the third push switch 10*c* with the second push switch 10*b* and closer to the second push switch 10*b* than the third push switch 10*c*. Accordingly, when the manipulation knob 2 is tiltably manipulated and the driver 3 descends, a pushing force from the manipulation knob 2 is applied to the portion of the operation plate 5 close to the first push switch 10*a*, while when the manipulation knob 2 is tiltably manipulated in the reverse direction and the driver 4 descends, the pushing force from the manipulation knob 2 is applied to the portion of the operation plate 5 close to the second push switch 10*b*.

Figure 5:
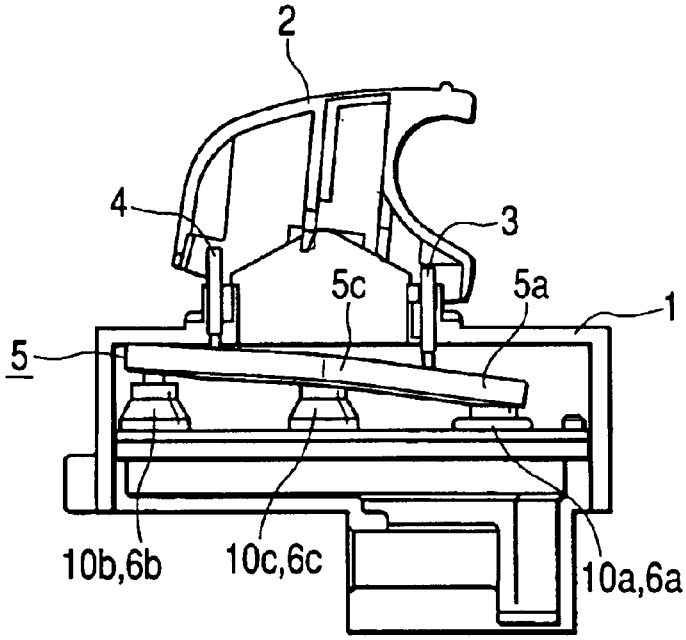
FIG. 5 is an operation explanatory view showing a first-stage ON state of the seesaw switch apparatus shown in FIG. 1.

Next, the manner of operation of the two-stage movement seesaw switch apparatus having such a constitution is explained. When the tilting manipulation which rotates the manipulation knob 2 in the clockwise direction in FIG. 2 is performed, along with descending of the driver 3 caused by pushing of the manipulation knob 2, first of all, the operation plate 5 is tilted using the third push switch 10*c* as a fulcrum due to the difference in moment of force and hence, the click rubber 6*a* is pushed into the distal end of the first extension 5*a* and receives the buckling deformation as shown in FIG. 5 whereby the first push switch 10*a* performs the ON operation. Further, when the manipulating force applied to the manipulation knob 2 is released after performing the ON operation of the first push switch 10*a*, the click rubber 6*a* which is subjected to the buckling deformation restores its original shape due to the resiliency thereof and hence, the operation plate 5 and the driver 3 are pushed upwardly whereby the manipulation knob 2 restores the neutral position shown in FIG. 2 and the first push switch 10*a* assumes the OFF state. According to this embodiment, the switch apparatus is configured such that an electric signal which opens the window is outputted when the first push switch 10*a* assumes the ON state and hence, by turning on or off the first push switch 10*a*, the manipulator can perform the manual manipulation which can open the window by an arbitrary amount.

Figure 6:
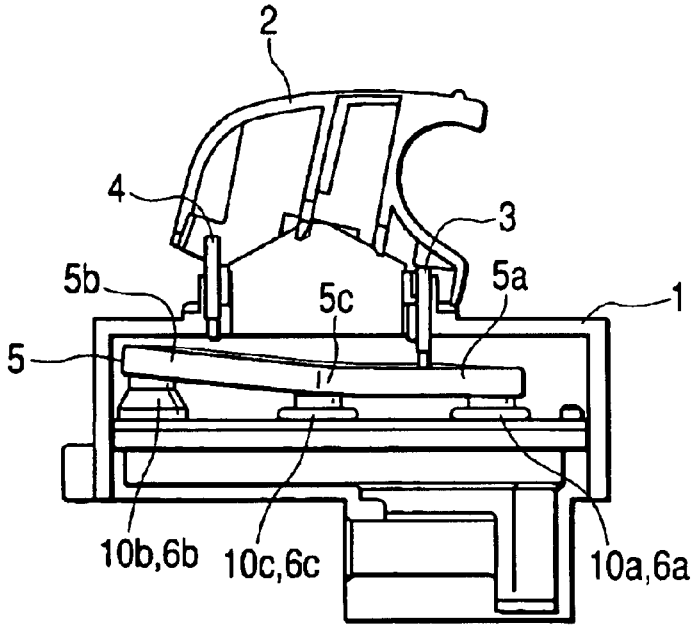
FIG. 6 is an operation explanatory view showing a second-stage ON state of the seesaw switch apparatus shown in FIG. 1.
Figure 7:
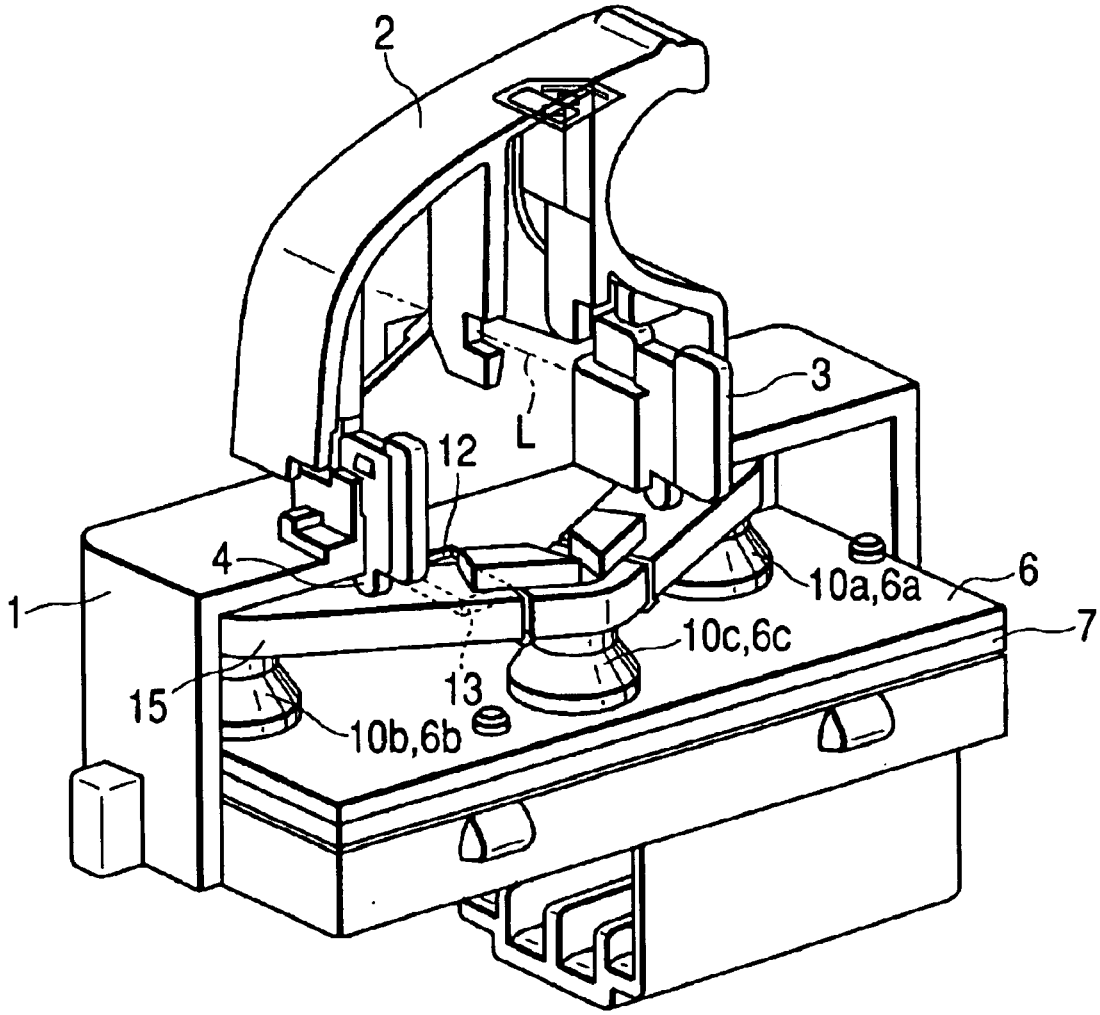
FIG. 7 is a perspective view showing a two-stage movement seesaw switch apparatus according to another embodiment of the present invention.
Figure 8A:
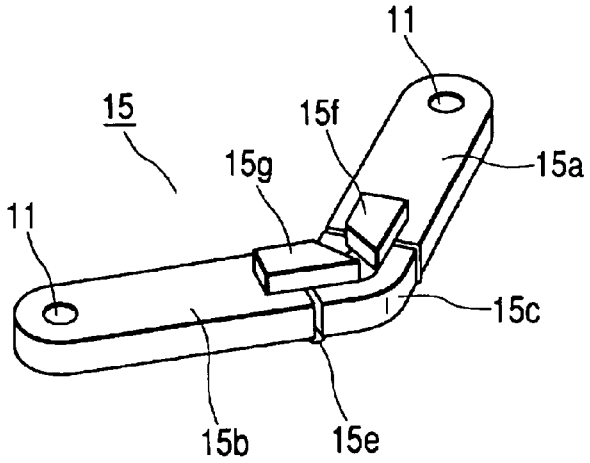
FIG. 8*a* is a perspective view of an operation plate used in the seesaw switch apparatus shown in FIG. 7.
Figure 8B:
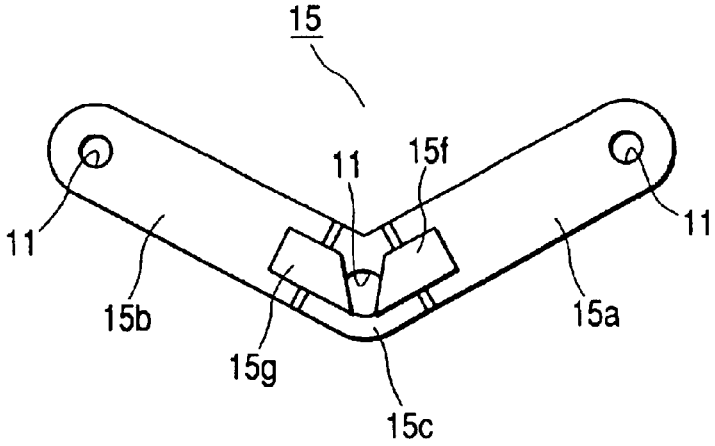
FIG. 8*b* is a plan view of the operation plate shown in FIG. 8*a;*
Figure 8C:
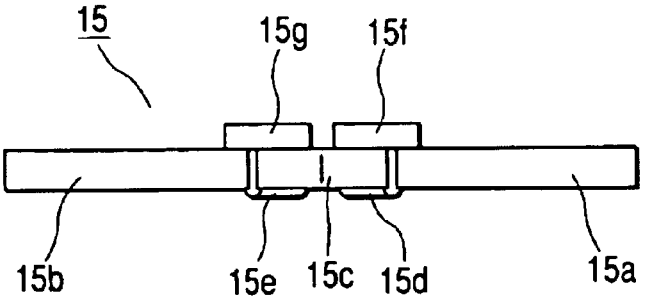
FIG. 8*c* is a side view of the operation plate shown in FIG. 8*a;*

Further, when the manipulation knob 2 is further tilted in the state that the first push switch 10*a* assumes the ON operation, the operation plate 5 is tilted using the first push switch 10*a* in the ON state as a fulcrum. Accordingly, the click rubber 6*c* is pushed into the bend 5*c* and is subjected to the buckling deformation as shown in FIG. 6 and hence, the third push switch 10*c* performs the ON operation. Here, the second push switch 10*b* makes an angle with respect to a straight line which connects the first push switch 10*a* with the second push switch 10*b* and is arranged at a side opposite to a side where the first push switch 10*a* exists and hence, when the driver 3 pushes the operation plate 5 at the side close to the first push switch 10*a*, the operation plate 5 is tilted using the vicinity of the straight line which connects the first push switch 10*a* with the third push switch 10*c* as an axis whereby the pushing force of the driver 3 is hardly transmitted to the second push switch 10*b* and the second push switch 10*b* does not perform the ON operation. In this embodiment, the switch apparatus is configured such that when both of the first and the third push switches 10*a*, 10*c* assume the ON state, an electric signal which fully opens the window is outputted and hence, the manipulator can perform an automatic manipulation which automatically fully opens the window by largely rotating the manipulation knob 2 in the clockwise direction shown in FIG. 2 so as to make the third push switch 10*c* perform the ON operation. Here, when the manipulating force applied to the manipulation knob 2 is released after performing the ON operation of the third push switch 10*c*, the click rubbers 6*a*, 6*c* which are subjected to the buckling deformation restore their original shapes due to the resiliency thereof and hence, the operation plate 5 and the driver 3 are pushed upwardly whereby the manipulation knob 2 restores the neutral position shown in FIG. 2 and both of the first and the third push switches 10*a*, 10*c* assume the OFF state.

The manner of operation when the tilting manipulation which rotates the manipulation knob 2 in the counterclockwise direction shown in FIG. 2 is substantially equal. That is, in the process that the driver 4 which is pushed by the manipulation knob 2 descends by a given amount, the operation plate 5 is tilted using the third push switch 10*c* as a fulcrum and the second push switch 10*b* performs the ON operation whereby the manipulator can perform the manual manipulation which closes the window by an arbitrary amount. Then, when the manipulation knob 2 is further tilted in this state, the operation plate 5 is tilted using the second push switch 10*b* as a fulcrum and the third push switch 10*c* is turned ON whereby the manipulator can perform the automatic manipulation which fully and automatically closes the window.

As mentioned above, the two-stage movement seesaw switch apparatus according to this embodiment can, using three push switches 10*a* to 10*c* which are driven by pushing the common operation plate 5, take out four types of electric signals, namely the signal which is outputted when only the first push switch 10*a* assumes the ON state, the signal which is outputted when both of the first and the third push switches 10*a*, 10*c* assume the ON state, the signal which is outputted only when the second push switch 10*b* assumes the ON state, and the signal which is outputted when both of the second and the third push switches 10*b*, 10*c* assume the ON state. That is, the seesaw switch apparatus which is capable of outputting four types of electric signals in response to the tilting direction and the tilting angle of the manipulation knob 2 can be realized using the small number of parts and hence, the seesaw switch apparatus can be manufactured at a low cost. Further, the operation plate 5 has an approximately L-shape in a plan view and hence, three push switches 10*a* to 10*c* can be arranged within a small area whereby the seesaw switch apparatus can be easily miniaturized. Further, since the illuminator 13 which is exposed in a projecting manner between the first extension 5*a* and the second extension 5*b* of the operation plate 5 is provided at the side of the third push switch 10*c*, it is possible to realize without difficulty the two-stage movement seesaw switch apparatus of an illumination type which can illuminate the display portion 2*a* of the manipulation knob 2 without impeding the miniaturization.

Here, by constituting the seesaw switch apparatus such that the click rubbers 6*a* to 6*c* provided with the movable contacts 8 are adopted as the push switches 10*a* to 10*c* and the tops of the respective click rubbers 6*a* to 6*c* engage with the engaging holes 11 formed in the operation plate 5 as in the case of this embodiment, it is possible to provide inexpensive push switches which can obtain a clear click feeling and a sufficient restoring force. Further, these push switches exhibit the favorable assembling property. Accordingly, it is preferable to constitute the push switches 10*a* to 10*c* as in the case of this embodiment.

FIG. 7 to FIG. 11 show a two-stage movement seesaw switch apparatus according to another embodiment of the present invention. Here, in these FIG. 7 to FIG. 11, portions identical with the portions according to the previous embodiment shown in FIG. 1 to FIG. 6 are indicated by the same symbols and their repeated explanation is omitted when necessary.

The two-stage movement seesaw switch apparatus according to another embodiment of the present invention differs from the previously-mentioned embodiment with respect to the constitution of an operation plate 15 which operates respective push switches 10*a* to 10*c*. That is, although the operation plate 15 according to this embodiment has an approximately L-shape in a plan view, the operation plate 15 is not formed of a single sheet of plate different from the operation sheet of the previous embodiment which is made of a single sheet of plate. That is, the operation plate 15 according to this embodiment is formed by resiliently connecting a bend 15*c* which constitutes an intermediate portion and a first extension 15*a* and a second extension 15*b* which extend from both sides of the bend 15*c* using a first resilient portion 15*d* and a second resilient portion 15*e* having a semi-cylindrical shape and having a thin wall. Further, the operation plate includes a first pushing force transmission portion 15*f* which includes a lower face projected from the first extension 15*a* to the bend 15*c* side and brought into contact with an upper face of the bend 15*c* and pushes and drives the bend 15*c* when the first extension 15*a* is tilted by a pushing force of the manipulation knob 2 using the first push switch 10*a* as a fulcrum, and a second pushing force transmission portion 15*g* which includes a lower face projected from the second extension 15*b* to the bend 15*c* side and brought into contact with an upper face of the bend 15*c* and pushes and drives the bend 15*c* when the second extension 15*b* is tilted by a pushing force of the manipulation knob 2 using the second push switch 10*b* as a fulcrum. However, the operation plate 15 is an integrally molded product and engaging holes 11 for allowing the insertion and the engagement of tops of respective click rubbers 6*a* to 6*c* are formed at three portions at respective distal ends of the first and the second extensions 15*a*, 15*b* and the bend 15*c*.

Other constitutions of this embodiment are substantially equal to the corresponding constitutions of the previously mentioned embodiment, wherein a lower end of one driver 3 is brought into contact with a portion of the first extension 15*a* closer to the first push switch 10*a* than the third push switch 10*c* and a lower end of another driver 4 is brought into contact with a portion of the second extension 15*b* closer to the second push switch 10*b* than the third push switch 10*c*.

Figure 9:
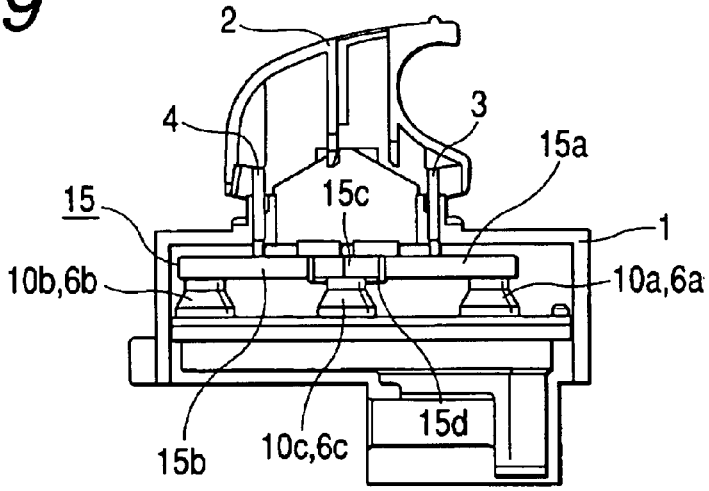
FIG. 9 is an operation explanatory view showing a non-manipulating state of the seesaw switch apparatus shown in FIG. 7.
Figure 10:
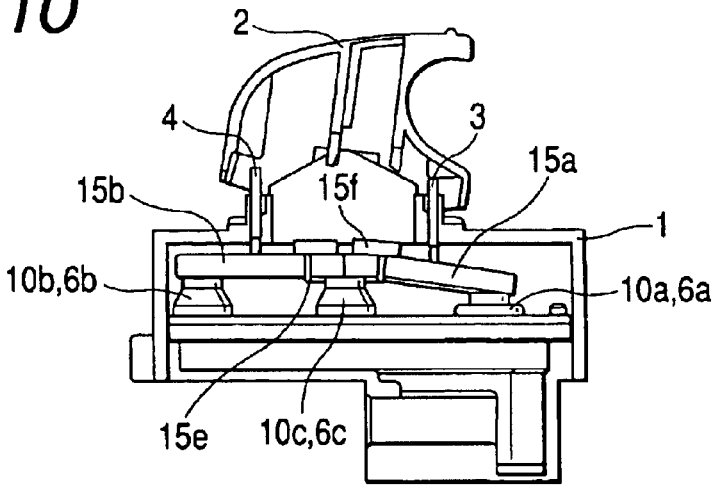
FIG. 10 is an operation explanatory view showing a first-stage ON state of the seesaw switch apparatus shown in FIG. 7.
Figure 11:
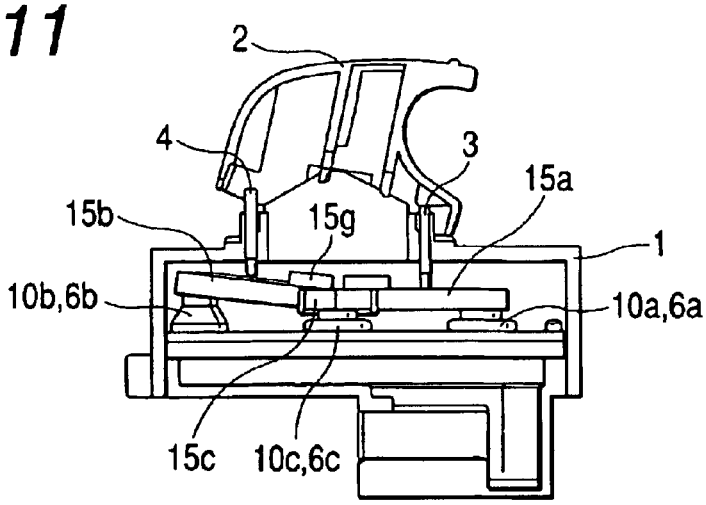
FIG. 11 is an operation explanatory view showing a second-stage ON state of the seesaw switch apparatus shown in FIG. 7.

To explain the operation of this two-stage movement seesaw switch apparatus, when the tilting manipulation which rotates the manipulation knob 2 in the clockwise direction shown in FIG. 9 is performed, the driver 3 is pushed by the manipulation knob 2 and descends and hence, the first extension 15*a* of the operation plate 15 is tilted as shown in FIG. 10 due to the difference in the moment of force using the third push switch 10*c* as a fulcrum. Here, since the first resilient portion 15*d* receives the resilient deformation, the pushing force of the manipulation knob 2 is hardly transmitted to the bend 15*c*. Then, when the driver 3 descends by a given amount, the click rubber 6*a* is pushed into a distal end of the first extension 15*a* and receives the buckling deformation and hence, the first push switch 10*a* performs the ON operation. Then, when the manipulation knob 2 is further tilted in this state, the driver 3 further descends and hence, the first extension 15*a* is tilted in a lying posture using the first push switch 10*a* in the ON state as a fulcrum. In this process, the first pushing force transmission portion 15*f* pushes the bend 15*c* from above. Accordingly, by tilting the manipulation knob 2 by an angle equal to or more than a given angle, as shown in FIG. 11, the first pushing transmission portion 15*f* generates the buckling deformation of the click rubber 6*c* by way of the bend 15*c* and the third push switch 10*c* performs the ON operation. Here, since the second resilient portion 15*e* receives the resilient deformation, the pushing force of the manipulation knob 2 is hardly transmitted to the second extension 15*b*. Further, when the manipulating force is released after performing the ON operation of the first push switch 10*a* and the third push switch 10*c*, the first extension 15*a* and the bend 15*c* are pushed upwardly due to a resilient force of the click rubber 6*a* and the click rubber 6*c* and hence, the manipulation knob 2 returns to the neutral position shown in FIG. 9 and the first push switch 10*a* and the third push switch 10*c* assume the OFF state.

The manner of operation when the tilting manipulation which rotates the manipulation knob 2 in the counterclockwise direction shown in FIG. 9 is also substantially equal, wherein in the process that the driver 4 which is pushed by the manipulation knob 2 descends, the second extension 15*b* is tilted while resiliently deforming the second resilient portion 15*e* using the third push switch 10*c* as a fulcrum and the distal end of the extension 15*b* makes the second push switch 10*b* perform the ON operation. Further, when the manipulation knob 2 is further tilted in this state, the second extension 15*b* is further tilted in a lying posture using the second push switch 10*b* as a fulcrum and hence, the second pushing force transmission portion 15*g* pushes the bend 15*c* from above while resiliently deforming the first resilient portion 15*d* and hence, the third push switch 10*c* is made to perform the ON operation.

The manner of operation when the tilting manipulation which rotates the manipulation knob 2 in the counterclockwise direction shown in FIG. 9 is also substantially equal, wherein in the process that the driver 4 which is pushed by the manipulation knob 2 descends, the second extension 15*b* is tilted while resiliently deforming the second resilient portion 15*e* using the third push switch 10*c* as a fulcrum and the distal end of the extension 15*b* makes the second push switch 10*b* perform the ON operation. Further, when the manipulation knob 2 is further tilted in this state, the second extension 15*b* is further tilted in a lying posture using the second push switch 10*b* as a fulcrum and hence, the second pushing force transmission portion 15*c* pushes the bend 15*c* from above while resiliently deforming the first resilient portion 15*d* and hence, the third push switch 10*c* is made to perform the ON operation.

In this manner, in the two-stage movement seesaw switch apparatus using the operation plate 15 which is not formed of a single sheet of plate, when the first extension 15*a* or the second extension 15*b* is tilted due to the pushing force of the manipulation knob 2 using the third push switch 10*c* as a fulcrum, the first resilient portion 15*d* or the second resilient portion 15*e* receives the resilient deformation and hence, the pushing force of the manipulation knob 2 is hardly transmitted to the bend 15*c* whereby when the first push switch 10*a* or the second push switch 10*b* is operated, there is no possibility that the third push switch 10*c* is erroneously operated. Further, when the first extension 15*a* or the second extension 15*b* is tilted using the first push switch 10*a* or the second push switch 10*b* held in the ON state as a fulcrum, the bend 15*c* is surely pushed due to the first pushing force transmission portion 15*f* or the second pushing force transmission portion 15*g* so as to operate the third push switch 10*c* and, at the same time, since the resilient portion 15*e* or 15*d* receives the resilient deformation, the pushing force from the manipulation knob 2 is hardly transmitted to the remaining push switch 10*b* or 10*a* whereby there is no possibility of an erroneous operation.

In the above-mentioned embodiment, although an example in which push switch uses the click rubber as the holding body has been explained, the push switch is not limited to such a structure and any arbitrary push switch which belongs to known techniques can be used provided that such a push switch gives a click feeling.

The present invention is exercised in the above-mentioned modes and exhibits following advantageous effects.

Since four types of electric signals can be taken out or generated by three push switches which are driven by pushing the common operation plate, it is possible to realize the two-stage movement seesaw switch apparatus which is capable of outputting four types of electric signals in response to the tiling direction and the tilting angle of the manipulation knob with the small number of parts. Accordingly, the present invention is advantageous in realizing the reduction of manufacturing cost of the seesaw switch apparatus. Further since the number of push switches and operation plates can be reduced, the miniaturization of the seesaw switch apparatus is facilitated.

Further, by forming the operation plate in an approximately L-shape in a plan view which extends the first extension and the second extension from both sides of the bend, is possible to realize the constitution in which the first and the third push switches can be sequentially operated by pushing and driving one end side of the operation plate and the second and the third push switches can be sequentially operated by pushing and driving another end side of the operation plate. Further, by providing the illuminator which is exposed and projected between the first and second extensions at the side of the third push switch, the two-stage movement seesaw switch apparatus of illumination type can be realized without difficultly.

What is claimed is:

1. A two-stage movement seesaw switch apparatus comprising:

a manipulation knob which is tiltably supported;

a pair of elevatable drivers corresponding to a tilting direction of the manipulation knob;

an operation plate which is pushed and driven by the manipulation knob by way of the drivers;

a first push switch and a second push switch which support both ends of the operation plate; and a third push switch which is arranged at a position displaced from a straight line which connects both push the first and second switches and supports an intermediate portion of the operation plate, wherein one of the drivers imparts a pushing force from the manipulation knob to a portion of the operation plate closer to the first push switch than the third push switch so as to make the operation plate sequentially operate the first push switch and the third push switch in response to a descending amount of the driver, and wherein the other of the drivers imparts a pushing force from the manipulation knob to a portion of the operation plate closer to the second push switch than the third push switch so as to make the operation plate sequentially operate the second push switch and the third push switch in response to a descending amount of the other of the drivers.

2. The two-stage movement seesaw switch apparatus according to claim 1, wherein the operation plate includes a bend which is supported by the third push switch as well as a first extension and a second extension which extend from the bend in a truncated chevron shape, wherein a distal end of the first extension is supported by the first push switch, and wherein a distal end of the second extension is supported by the second push switch.

3. The two-stage movement seesaw switch apparatus according to claim 2, wherein an illuminator which is exposed in a projecting manner between the first extension and the second extension of the operation plate is provided at a side of the third push switch.

4. The two-stage movement seesaw switch apparatus according to claim 2, wherein the operation plate includes a first resilient portion which connects the bend with the first extension, a first pushing force transmission portion which is projected from the first extension to a bend side and pushes and drives the bend when the first extension is tilted using the first push switch as a fulcrum due to the pushing force of the manipulation knob, a second resilient portion which connects the bend with the second extension, and a second pushing force transmission portion which is projected from the second extension to a bend side and pushes and drives the bend when the second extension is tilted using the second push switch as a fulcrum due to the pushing force of the manipulation knob.

5. A two-stage movement seesaw switch apparatus according to claim 1, wherein each of the push switches includes a fixed contact and a click rubber which is provided with a movable contact which is brought into contact with or is separated from the fixed contact and is capable of performing buckling deformation, and wherein a top of the click rubber engages with the operation plate.

* * * * *